US005669257A

United States Patent [19]

Inoue et al.

[11] Patent Number: 5,669,257

[45] Date of Patent: Sep. 23, 1997

[54] METHOD OF CRIMPING TERMINAL AND APPARATUS FOR THE SAME

[75] Inventors: Toshihiro Inoue; Kazuhiko Takada, both of Shizuoka, Japan

[73] Assignee: Yazaki Corporation, Tokyo, Japan

[21] Appl. No.: 576,090

[22] Filed: Dec. 21, 1995

[30] Foreign Application Priority Data

Dec. 28, 1994 [JP] Japan ..... 6-328826

[51] Int. Cl.[6] ..... B21D 9/08; B21J 9/18

[52] U.S. Cl. ..... 72/20.1; 72/443; 72/452.5; 72/374

[58] Field of Search ..... 72/19.9, 20.1, 72/21.4, 443, 449, 450, 414, 415, 416, 702, 374

[56] References Cited

U.S. PATENT DOCUMENTS

| | | | |
|---|---|---|---|
| 4,434,646 | 3/1984 | Maeda et al. | 72/451 |
| 4,653,311 | 3/1987 | Tack, Jr. | 72/443 |
| 4,723,429 | 2/1988 | Weber et al. | 72/443 |
| 5,069,060 | 12/1991 | Ishii . | |
| 5,079,489 | 1/1992 | Ishii . | |
| 5,115,735 | 5/1992 | Gloe et al. . | |
| 5,129,317 | 7/1992 | Gloe et al. . | |

FOREIGN PATENT DOCUMENTS

| | | |
|---|---|---|
| 3-189037 | 8/1991 | Japan . |
| 5-29055 | 2/1993 | Japan . |
| 5-29056 | 2/1993 | Japan . |
| 6-25911 | 7/1994 | Japan . |

*Primary Examiner*—David Jones

*Attorney, Agent, or Firm*—Armstrong, Westerman, Hattori, McLeland & Naughton

[57] ABSTRACT

A terminal barrel is crimped to a wire laid on an anvil. In the crimping operation, a servo-motor drives a driving axis, the forward and reverse rotation of which vertically reciprocates a crimper. The operation includes the steps of: preliminary recording reference speeds or accelerations of the crimper at vertical positions in the reciprocating movement, and the reference value of a current which is supplied to the servo-motor when the terminal is crimped; descending the crimper at the reference speeds corresponding to the crimper position while the crimper descends from its top position to its crimping start position; crimping the terminal by supplying the reference current to the servo-motor during a predetermined period while the crimper is crimping the terminal.

12 Claims, 11 Drawing Sheets

METHOD OF CRIMPING TERMINAL AND APPARATUS FOR THE SAME

BACKGROUND OF THE INVENTION

1. Field of the Invention

This invention relates to an improved method of crimping a terminal and an apparatus for the same that manufactures terminal equipped wires to produce a wire harness or the like.

2. Description of the Prior Art

There has been used a terminal crimping apparatus provided with a flywheel, as shown in FIG. 9, for a long time, as one of a type for performing the crimping method. In the apparatus, the flywheel 101, driven by a motor (not shown), rotates at a constant speed in the direction of an arrow head, and a crank arm 103 pivotably attached to an off-center pin 102 pivots around a pivot axis 104. Further, the crank arm 103 vertically reciprocates a ram 107 pivotably attached by an axial pin 106 to the crank arm 103 by way of a connection arm 105, which vertically reciprocates a crimper 108 integrally connected to the ram 107. Thereby, the crimper 108 and a cooperative anvil 109 compress and crimp a stripped wire end w of a wire W to a barrel c of a terminal C.

The above-mentioned flywheel-type crimping apparatus is suitable to mass production, because the crimper 108 vertically reciprocates with higher speeds. However, as the crisper 108 passes instantaneously its bottom dead point (that is, not stopped at the bottom dead point), its crimping operation is instantaneous, resulting in the disadvantage of an insufficient tensile strength in the crimped terminals. FIG. 11 shows the relation between time and position of the crimper 108 and explains that a crimping, contacting period to of the crimper 108 and the terminal C is only an instance. Moreover, the crimping apparatus has the disadvantages that the size of the flywheel 101 determines the press depth (crimp height), that the motor running cost is large, and that it is difficult to detect an abnormal state during crimping operation. Additionally, a crimp height is not easily adjusted because only a lowest position of the crimper is selected so that the anvil height should be modified in a crimp height adjustment.

On the other hand, in Japanese Utility Model Publication No. Hei 6-25911, there is provided a crimping apparatus, as shown in FIG. 10, having a crimper 108' which is vertically moved by the rotation of a lead screw 110. Designated 111 is a servo-motor, 112 a primary wheel, 113 a secondary wheel, and 114 a timing belt.

Nevertheless, the above-mentioned lead-screw-type crimping apparatus has also the disadvantages that a large-scale apparatus is required to obtain a larger crimping load, that its operation speed is normally lower to result in lower productivity, and that many sensors are required to determine whether a terminal is correctly crimped, or otherwise a manual decision is required. Additionally, the screw mechanism is not suitable to a minute adjustment of a crimp height.

SUMMARY OF THE INVENTION

In view of the aforementioned drawbacks, an object of the invention is to provide a terminal crimping method and an apparatus thereof that can obtain a sufficient crimping strength with keeping a higher speed in the terminal crimping operation and, further, that can generate less noise.

To achieve the above-mentioned object, according to this invention, a terminal crimping method includes the steps of:

descending a crimper toward an anvil to crimp a terminal barrel laid on the anvil to an electrical wire; and stopping the crimper in a given time with the terminal pressed between the crimper and the anvil.

Preferably, the crimper descending speeds are considerably smaller between the crimping-contact start position and the crimper descending bottom position than between the crimper ascending top position and the crimping-contact start position.

In another aspect of this invention, a method of crimping a terminal barrel to a wire laid on an anvil in which a servo-motor drives a driving axis in the forward and reverse rotation to vertically reciprocate a crimper, the method comprising the steps of: preliminarily recording reference speeds or accelerations of the crimper at vertical positions in the reciprocating movement, and the reference value of a current which is supplied to the servo-motor when the terminal is crimped; descending the crimper at the reference speeds corresponding to the crimper position while the crimper descends from its top position to its crimping start position; crimping the terminal by supplying the reference current to the servo-motor during a predetermined period while the crimper is crimping the terminal.

Preferably, the crimper may begin to make contact with the terminal at a speed considerably decelerated before the contact.

Further, an encoder may provide pulses corresponding to the rotation angles of the servo-motor so as to determine the positions of the crimper, and detecting changing positions of the crimper may provide actual speeds of the crimper.

Moreover, a piston-crank mechanism with an off-center pin activated by the servo-motor vertically reciprocates the crimper, the terminal is crimped when the off-center pin is positioned at an intermediate position between its top dead point and its bottom dead point. Further, the rotation of the servo-motor is transmitted to vertically reciprocate the crimper by way of a reduction gear.

While, to achieve the above-mentioned object according to this invention, an apparatus for crimping a terminal barrel to a wire laid on an anvil includes a servo-motor for driving a driving axis in the forward and reverse rotation in order to vertically reciprocate a crimper, the apparatus comprising: a speed detecting means for detecting the speeds of the crimper during the vertical reciprocating motion; a position detecting means for detecting the positions of the crimper; a data recording means for preliminarily recording reference speeds or accelerations of the crimper at vertical positions in the reciprocating movement, and the reference value of a current which is supplied to the servo-motor when the terminal is crimped; a speed control means for controlling the crimper to descend at the reference speeds corresponding to the crimper position while the crimper descends from its top position to its crimping start position; a current control means for controlling supply of the reference current to the servo-motor during a predetermined period while the crimper is crimping the terminal.

Preferably, the crimper may begin to make contact to the terminal at a speed considerably decelerated before the contact.

Further, an encoder may provide pulses corresponding to the rotation angles of the servo-motor so as to determine the positions of the crimper.

Moreover, detecting changing positions of the crimper may provide actual speeds of the crimper; a piston-crank mechanism with an off-center pin activated by the servo-motor vertically may reciprocate the crimper, the terminal is crimped when the off-center pin is positioned at an intermediate position between its top dead point and its bottom dead point; and the servo-motor torque may be transmitted to vertically reciprocate the crimper by way of a reduction gear.

Referring to effects of the present invention, the crimper descends at the reference speeds corresponding to the crimper position while the crimper descends from its top position to its crimping start position, and the terminal is crimped by supplying the reference current to the servo-motor during a predetermined period while the crimper is crimping the terminal. Thereby, terminal barrels are restricted from a spring-back to obtain reliable products with a high crimping strength. Further, the crimper may begin to make contact with the terminal at a speed considerably decelerated before the contact, which can eliminate impact noises, resulting in providing an improved working environment. Moreover, an encoder may provide pulses corresponding to the rotation angles of the servo-motor so as to determine the positions and speeds of the crimper, which can provide a simplified crimping apparatus in which a crimp height is easily modified without moving the anvil for a different type of terminals. Further, the servo-motor torque may be transmitted to vertically reciprocate the crimper by way of a reduction gear, which can sufficiently crimp the terminal by a smaller torque in the servo-motor.

DETAILED DESCRIPTION OF PREFERRED EMBODIMENTS

Figure 1:
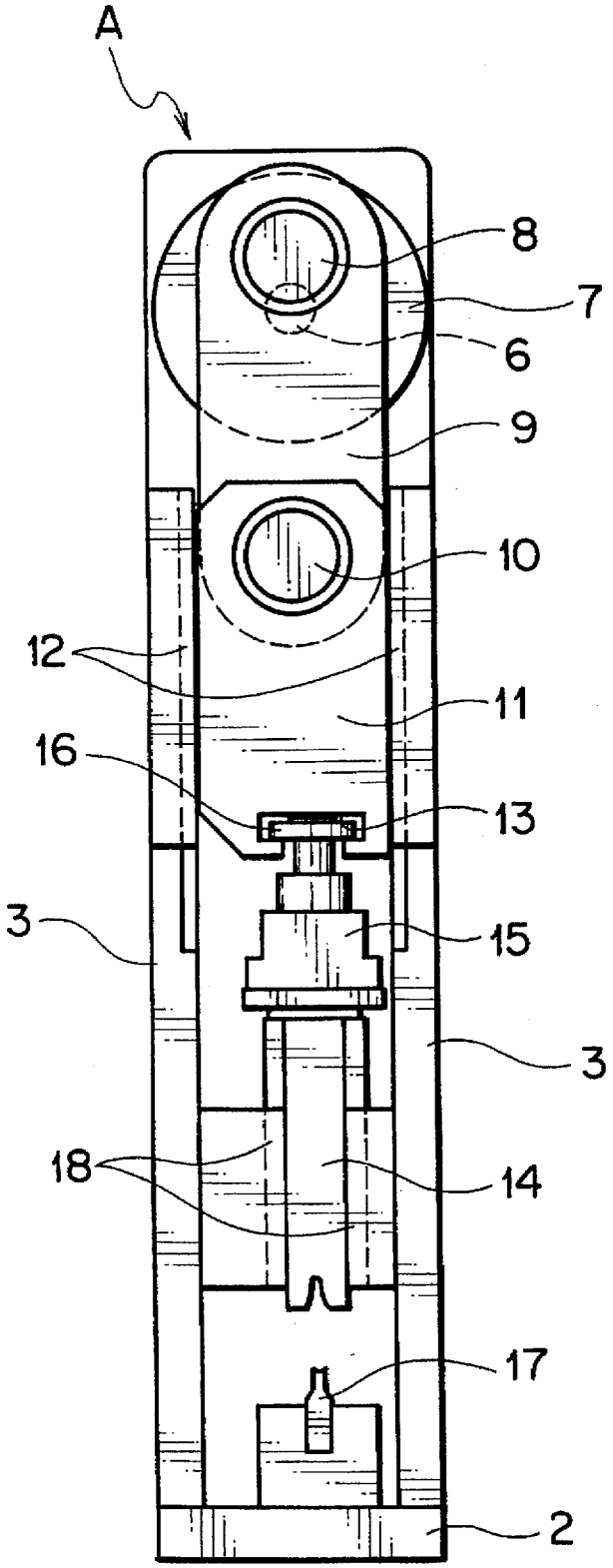
FIG. 1 is a front view showing an embodiment of a terminal crimping apparatus according to this invention.
Figure 2:
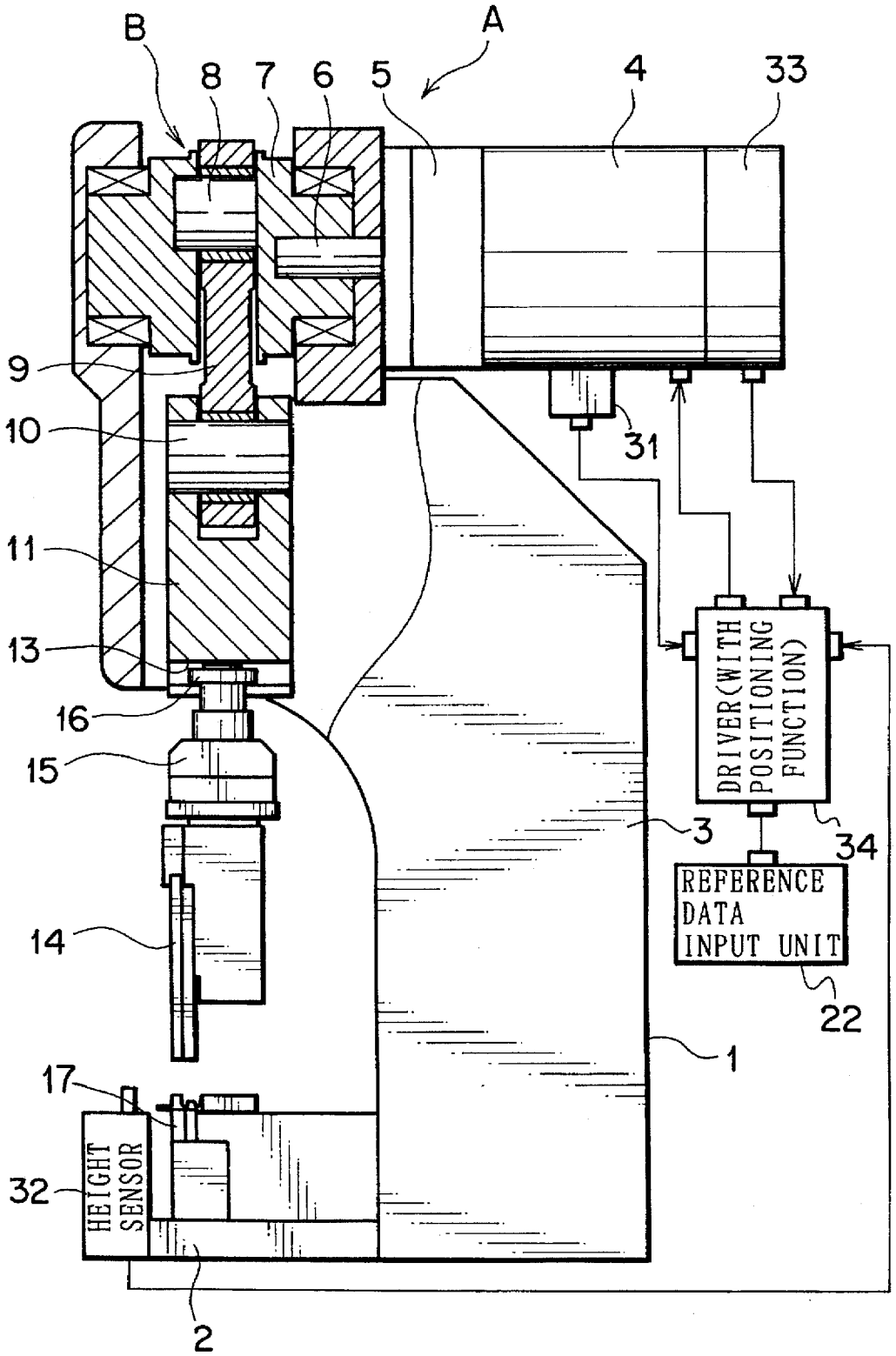
FIG. 2 is a side view of the terminal crimping apparatus of FIG. 1.

In FIGS. 1 and 2, designated 1 shows a casing for a terminal crimping apparatus A according to the present invention, which having a base plate 2 and side plates 3, 3 positioned at each side of the base plate 2. In the rear of, and above both the side plates 3, 3, there is provided and fixed an electrical servo-motor 4 with a reduction gear 5. The reduction gear 5 has an output axis 6 that axially connects to a circular plate 7 with an off-center pin 8. The off-center pin 8 is slidably axially connected to an upper end portion of a crank arm 9, a lower end portion of which being pivotably axially connected to a ram 11 by way of an axial pin 10. The ram 11 is disposed to slide upward and downward in ram guides 12, 12 provided on inner surfaces of both of the side plates 3, 3. The circular plate 7, the crank arm 9, the ram 11 and the ram guides 12, 12 difine a piston-crank mechanism B.

The ram 11, at a lower end thereof, has an engaging concave portion 13. The engaging concave portion 13 detachably engages with an engaging convex portion 16 of a crimper holder 15 holding a crimper 14. Just below the crimper 14, an anvil 17 is fixed on the base plate 2 in opposition to the crimper 14. Designated 18 is a guide plate for guiding the crimper holder 15, the guide plate 18 being fixed to an inner surface of the side plate 3 by way of a bracket (not shown).

The servo-motor 4 can rotate forwardly and reversely, which vertically reciprocates the crimper 14 by way of the ram 11 pivotably attached to the crank arm 9 by the piston-crank mechanism B. Further, the servo-motor 4 connects to a driver 34 to control the servo-motor operation. The driver 34 connects to a reference data input unit 22 that inputs reference data, such as terminal specifications (or terminal sizes), relative wire sizes, crimp heights (lowest descended positions of the crimper), and loads (electric currents) applied to the servo-motor 4. Further, on an output axis (not shown) of the servo-motor 4 there is attached a rotary encoder 33 that detects positions of the crimper 14 based on the number of rotations and feeds it back to the driver 34 that reads out the above-mentioned load current.

Designated 32 is a height sensor that senses a height of the crimper 14 just when a terminal is crimped and output the height to the driver 34 that determines whether the terminal crimping operation is correct. Furthermore, designated 31 is a temperature sensor sensing the temperature of a coil in the servo-motor 4.

Figure 3:
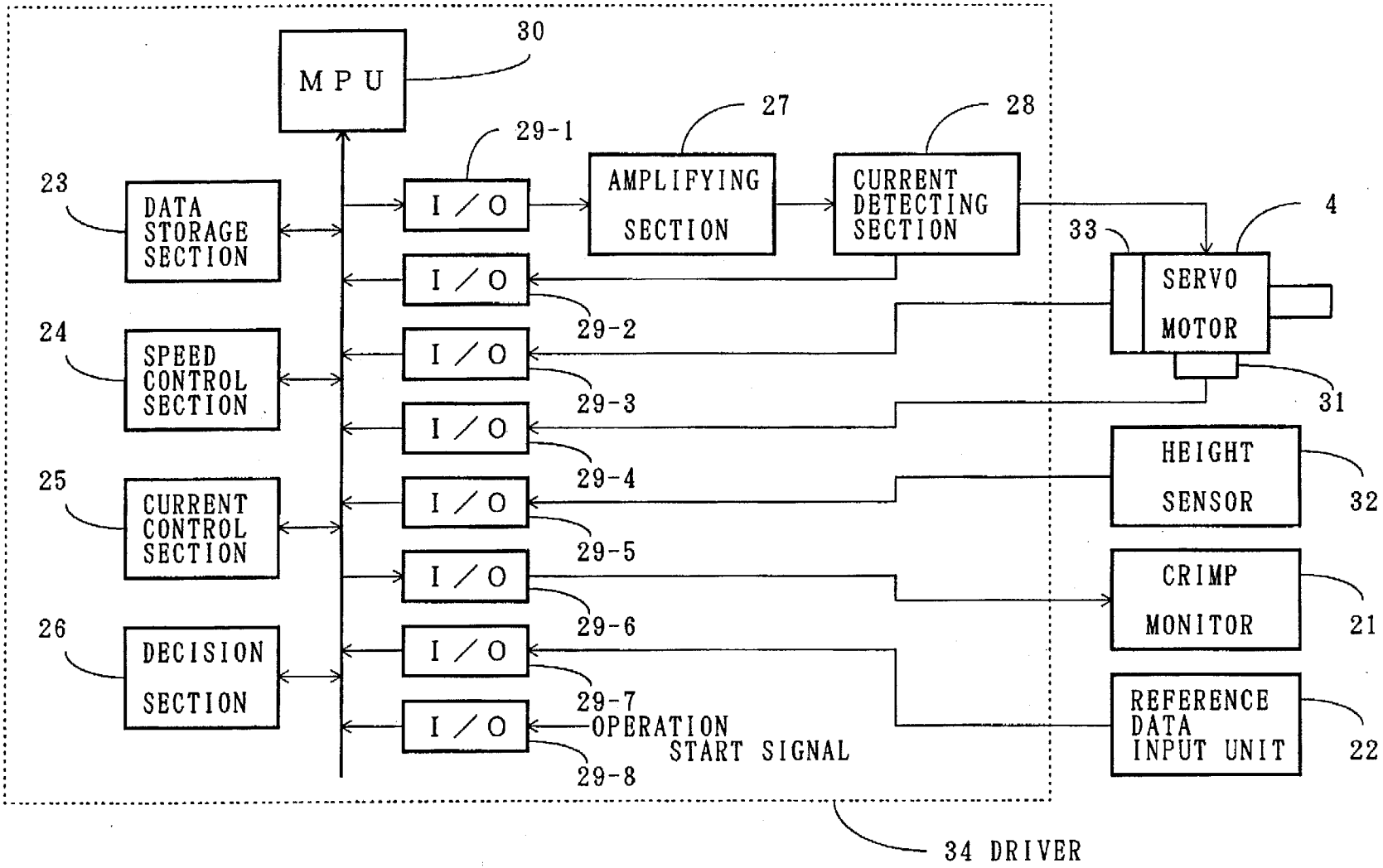
FIG. 3 is a functional block diagram showing a control system of the terminal crimping apparatus of FIG. 1.

FIG. 3 is a functional block diagram of the driver 34 that controls the servo-motor 4 in operation. As shown in the figure, the driver 34 is integrated as a control circuit, such as a central processing unit, and includes a data storage section 23, a speed control section 24, a current control section 25, a decision section 26, an amplifying section 27, a current detecting section 28, interfaces I/O 29-1 to 29-8, and a microprocessor unit(MPU) 30.

Next, before explaining the detailed operation of illustrated the embodiment of the present invention, basic operation of the embodiment is discussed referring to FIGS. 6 and 7.

Figure 6C:
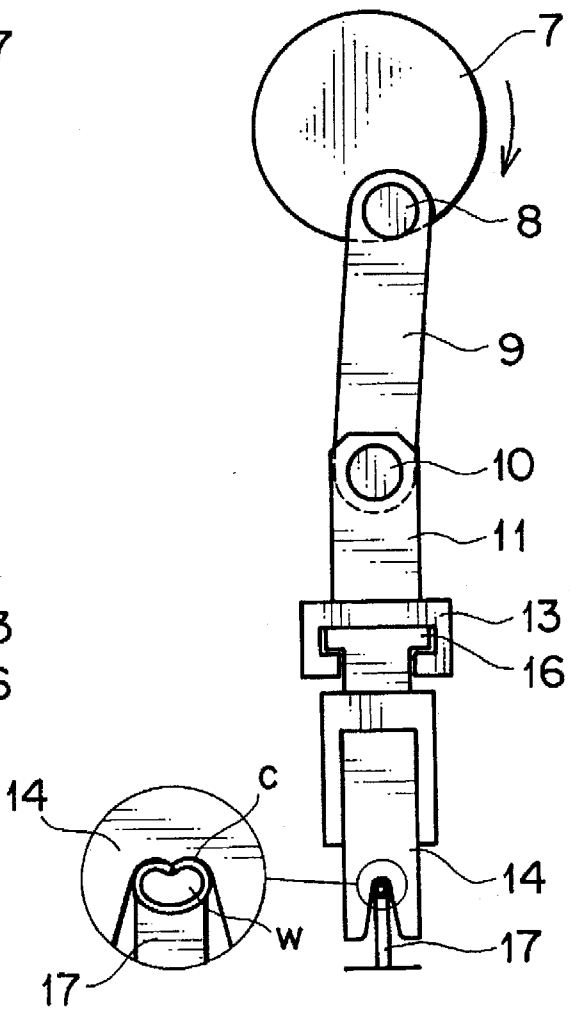
FIGS. 6A, 6B and 6C are illustrations respectively showing the operation steps of the terminal crimping apparatus of FIG. 1.
Figure 6B:
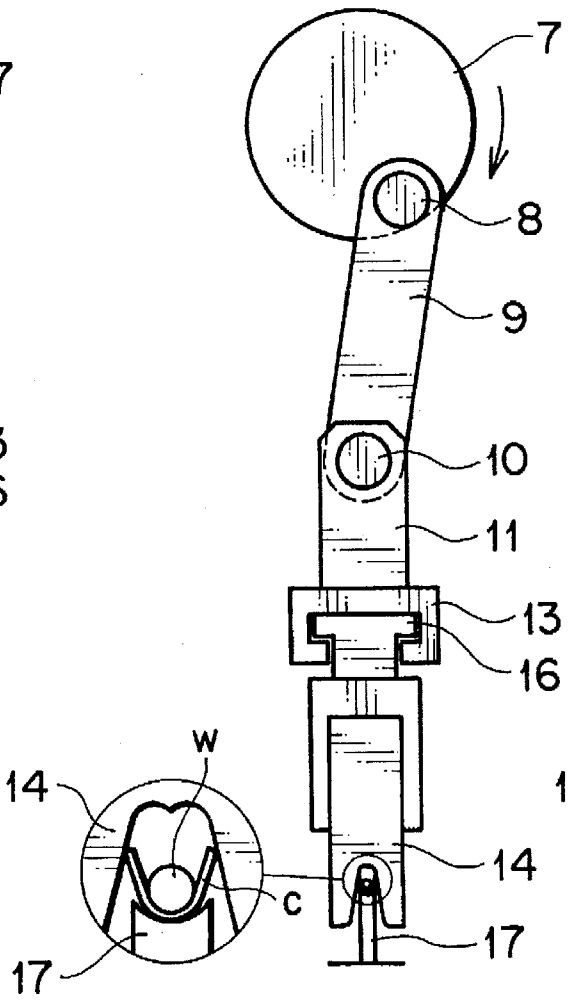
Figure 6A:
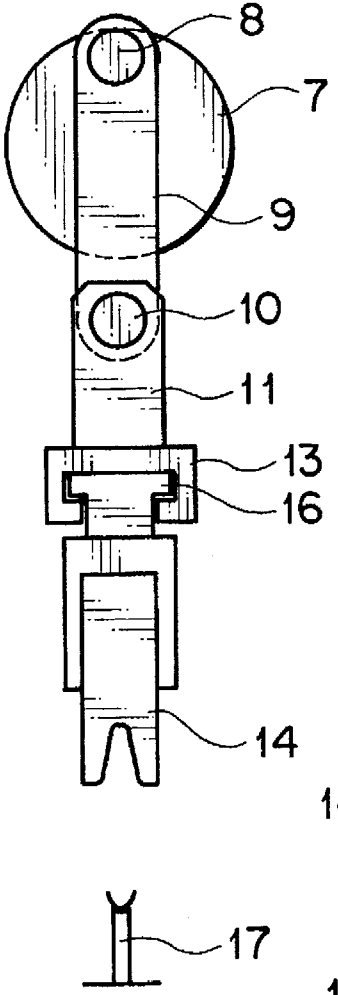
Figure 7A:
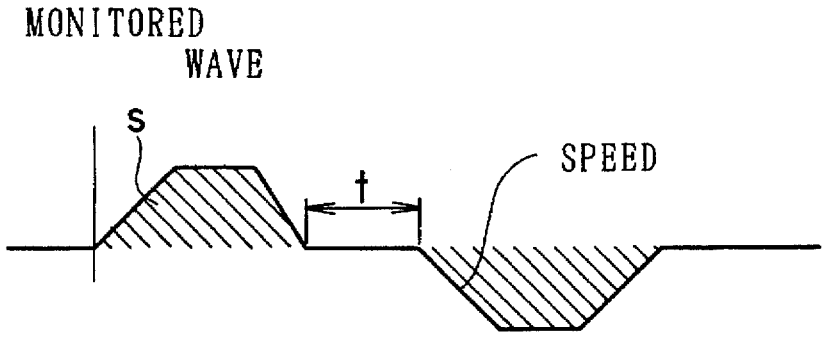
FIG. 7A is a graph showing the relation between time and the vertically reciprocating speed of a crimper in a crimping operation cycle controlled by the control system of FIG. 3.
Figure 7B:
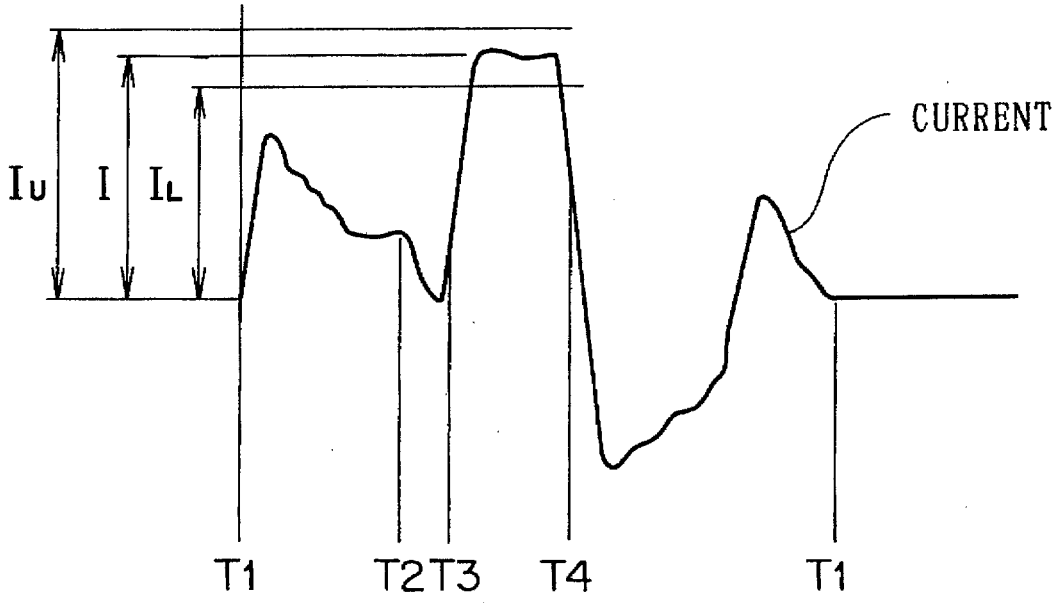
FIG. 7B is a graph showing the relation between time and the motor current of the same.

FIGS. 6A, 6B and 6C are diagrams explaining the operation of the terminal crimping apparatus. FIG. 7A is a graph showing the relation between time and the vertically reciprocating speed of the crimper 14 in the operation. Further, FIG. 7B is a graph showing the relation between time and the current of the servo-motor in the same operation in which reference points T1, T2, and T3 corresponds respectively to FIGS. 6A, 6B, and 6C.

FIG. 6A shows an initial step in the terminal crimping operation, in which the off-center pin 8 on the circular plate 7 is at the highest position; that is, the crimper 14 is at the top dead point. At that time, as shown in FIG. 7A, the descending speed of the crimper 14 is zero and the load current in the servo-motor 4 is also zero.

FIG. 6B shows an initial crimping step, in which the circular plate 7 rotates in an arrow head direction, the off-center pin 8 moves downward, and the crimper 14 has descended at a higher speed before engaging to the barrel c of the terminal C. However, the descending speed of the crimper 14 is decelerated and the load current for the servo-motor is reduced prior to the engagement.

FIG. 6C shows a stopping state in which the crimper 14 has stopped at its crimping position, after the circular plate 7 rotates in the arrow head direction so that the off-center pin 8 reaches near its bottom dead point and the crimper 14 and anvil 17 carry out a crimping operation. At that time, as the crimper 14 has been stopped during a stopping period t, the crimper 14 continues to press the barrel c of the terminal C and to oppose spring-back of the barrel c. Thereby, the load current reaches to a peak of a maximum rate. The press in the stopping state eliminates the spring-back of the barrel c to obtain a high crimping strength.

After the terminal is crimped, the servo-motor 4 reversely rotates, that is, the circular plate 7 rotates in the reverse direction to the arrow head in FIG. 6C so that the crimper ascends to return to the original state of FIG. 6A.

In FIG. 7A, at the crimping start position, that is, at T2, the descending speed of the crimper 14 is considerably smaller than the speed at which the crimper 14 descends from the top position to the crimping start position. Therefore, there are no impact noises generated as in the conventional flywheel-type crimping apparatus, which reduces noises to provide an improved working environment.

Further, referring to FIG. 3 again, before the apparatus is operated, the data storage section 23 stores data for operating the crimping apparatus A and data for deciding whether terminals are correctly crimped from the reference data input unit 22 by way of I/O 29-7.

The stored data for operating the crimping apparatus A are accelerated speeds of the servo-motor after the servo-motor begins to forwardly rotate at T1, a position of the crimper 14 when the crimper descending speed reaches a uniform rate during the descending of the crimper 14 activated by the motor rotation, a position of the crimper 14 and decelerated speeds of the crimper 14 when the crimper decelerates from the uniform rate at T2, a crimping start position of the crimper 14 at T3, a given internal t and a driving current to drive the servo-motor during the given time, accelerated speeds of the servo-motor when the servo-motor begins to reversely rotate to ascend the crimper 14 after a terminal is crimped at T4, a position of the crimper 14 when the crimper ascending speed reaches another uniform rate, a position of the crimper 14 when the crimper decelerates from the other uniform rate, and a stop position of the crimper 14.

Furthermore, data of positions of the crimper 14 are stored as corresponding to output values from the rotary encoder 33 attached to the servo-motor 4.

These data are preliminarily, experimentally obtained respectively for each crimped terminal size to be stored. Further, the data corresponding to plural types of terminals may be preliminarily stored so that any one of the data may be read out when required in a crimping operation.

Moreover, position data of the crimper 14 are stored to correspond to output values of the rotary encoder 33, that is, as corresponding to pivoting angles of the circular plate 7. Thereby, even for a different type of terminal, the crimp height can be promptly modified without changing a height of the anvil 17 as in the prior art, and the crimp height can be easily, minutely adjusted when a crimping operation starts, if required.

Further, the data for deciding whether terminals are correctly crimped include, as described later in detail, currents IU and IL shown in FIG. 7B, or the like. In FIG. 7B, I denotes a detected current when a certain terminal is normally crimped to a corresponding size wire; IU and IL denote an upper limit and a lower limit of the detected current respectively, IU and IL being determined based on a preliminary test result. It shows that in a normal crimping I is between IL and IU.

Figure 4:
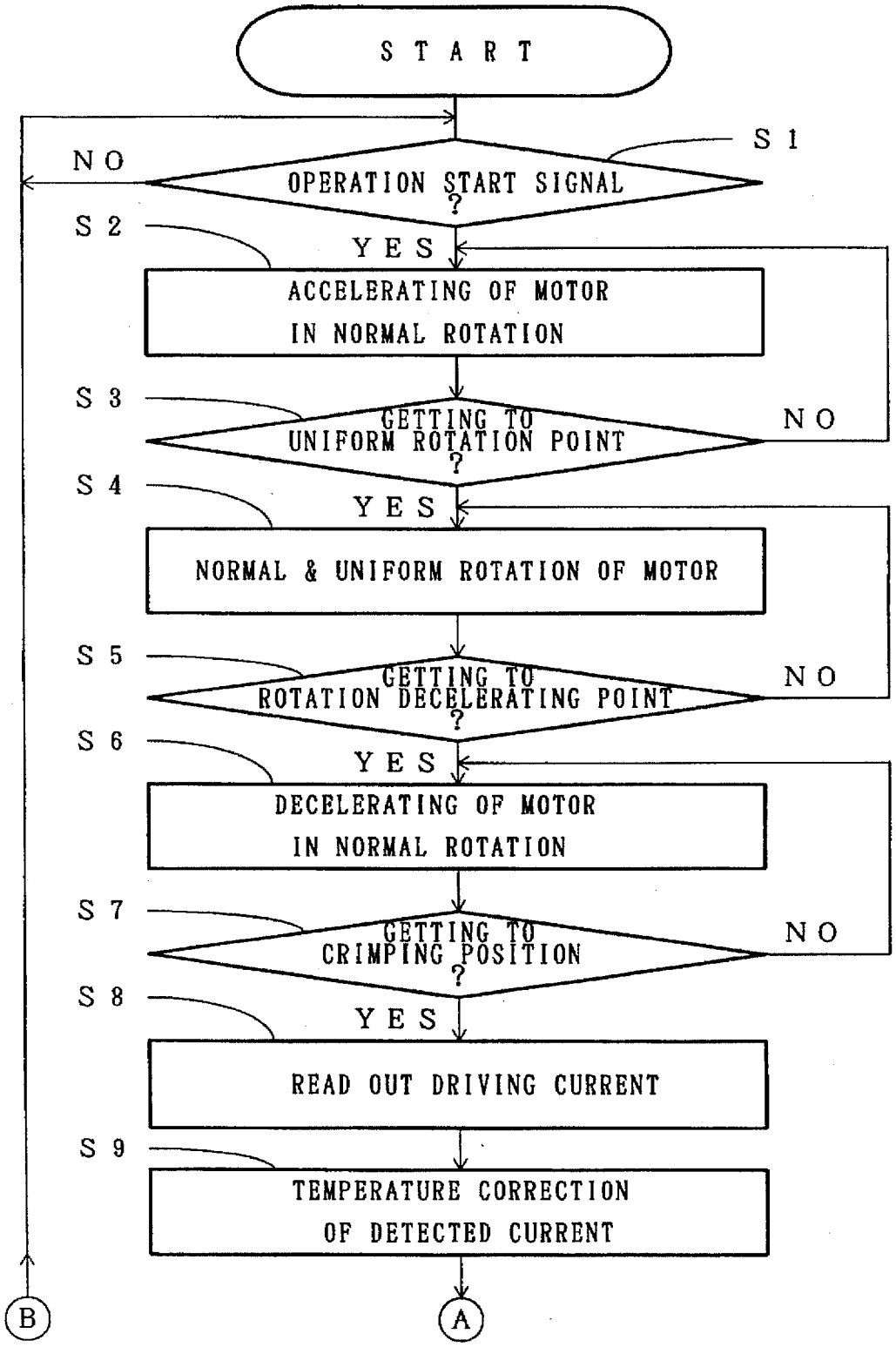
FIG. 4 is a flow chart showing operation of the control system of FIG. 3.
Figure 5:
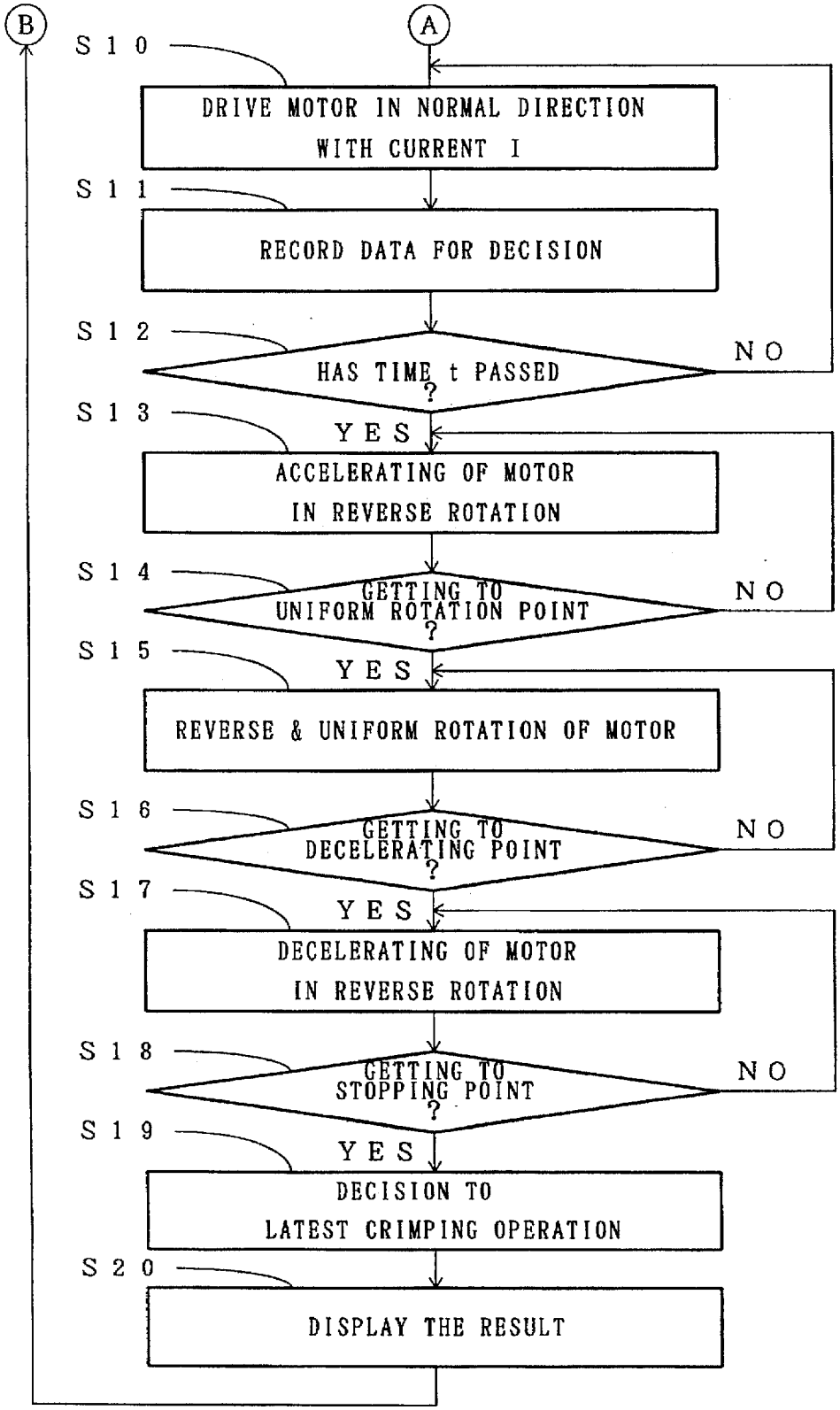
FIG. 5 is a flow chart showing operation of the control system of FIG. 3.

Next, referring to FIGS. 4 and 5, the operation of the driver 34 will be discussed. FIGS. 4 and 5 show operational flow charts of the driver 34.

In step S1, the speed control section 24 decides whether a starting signal to begin a crimping operation is inputted by way of I/O 29-8 and, if the decision is NO, the operation does not start until the decision becomes YES.

In step S2, the speed control section 24 reads out an accelerated forwardly rotating speed of the servo-motor 4 from the data storage section 23, and outputs a signal to the amplifying section 27 by way of I/O 29-1 so that the amplifying section 27 supplies a current to the servo-motor 4 in such way that the servo-motor 4 rotates at the read out accelerated speed.

The values outputted from the rotary encoder 33 by way of I/O 29-3 are differentiated to obtain rotation speeds of the motor and further the rotation speeds are differentiated to get rotation accelerations of the motor.

In step S3, The speed control section 24 determines whether a value outputted from the rotary encoder 33 by way of I/O 29-3 is equal to the value that is stored in the data storage section 23 and corresponds to a position from which a uniform rotation speed begins. If the decision is NO, step S2 continues to accelerate the motor, while if The decision is YES, a following step S4 makes the motor rotate at the uniform speed.

Further, when step S5 in the speed control section 24 detects the arrival to the deceleration starting position of the motor, the following step S6 decelerates the rotation of the motor. The next step S7 decides whether the crimper has reached the terminal crimping position, and if the decision is YES, the step S7 outputs a corresponding signal to the current control section 25.

In the current control section 25, step S8 reads out a current I stored in the data storage section 23 and required by the servo-motor 4 just in a crimping stage. The next step S9 corrects the current I based on a temperature outputted from the temperature sensor 31 by way of I/O 29-4 so that the motor torque becomes equal to the reference value. Further, the following step S10 outputs the current I by way of I/O 29-1.

In the decision section 26, step S11 records the decision reference data in a memory (not shown). The decision reference data will be discussed later in detail.

In the current control section 25, step S12 decides whether the servo-motor 4 has received the current I during the time t, and if the decision is NO, the steps S10 and S11 are executed again.

In the speed control section 24, step S13 reversely rotates the servo-motor 4 with a predetermined acceleration and, if in step S14 it is determined that the motor rotation has reached to a uniform speed, the following step S15 keeps the motor rotating at the uniform speed. When the next step 16 decides that the crimper has come to the deceleration starting position, the following step S17 decelerates the motor and step S18 stops the motor rotation based on the arrival to a stopping position.

In the decision section 26, step S19 decides whether the latest crimping operation has been normal based on the data recorded in step S11. Then, the following step S20 displays the results in a crimp monitor 21 and also outputs a warning signal in the case of an abnormal crimping operation.

Figure 8A:
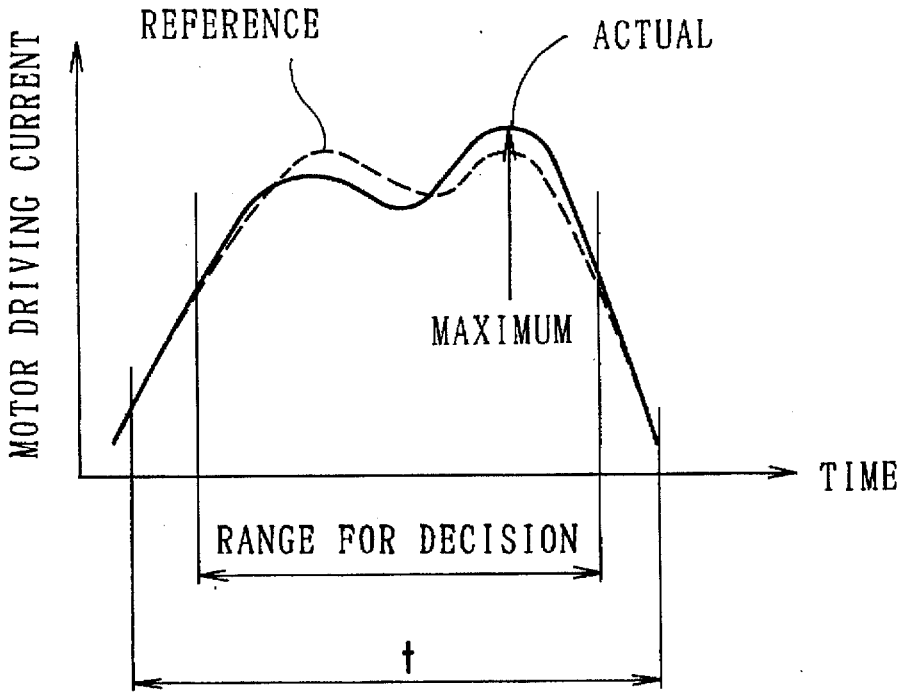
FIG. 8A is a graph explaining a method for deciding whether crimping is normal based on the motor driving currents.

For deciding whether the crimping operation is normal, as shown in FIG. 8A, step S11 records current values (driving current), which are detected in the current detecting section 28, supplied to the servo-motor 4 at constant time intervals.

FIG. 8A shows the driving current supplied to the motor 4 during the crimping operation in FIG. 7B. The current control section 25 controls in such way that standard currents, the values of which are stored in the data storage section, are supplied to the motor. In the motor stopping state, a uniform current is supplied to the motor, while the motor driving current changes when the motor begins to rotate to result in a modified control balance. When a terminal is just crimped, if there are no cores in the cable or if an insulated wire is crimped, the supplied current becomes smaller or larger than the standard currents in the normal crimping operation. Accordingly, in the present invention, whether the crimping is normal is decided based on thus changed current supplied to the motor.

Figure 8B:
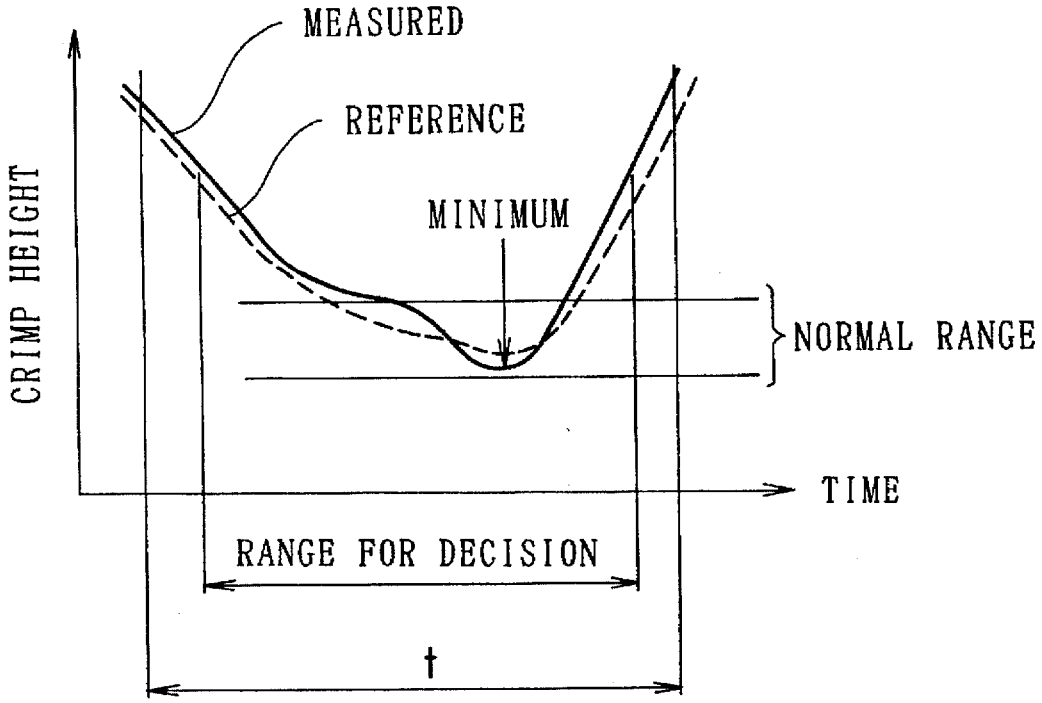
FIG. 8B is a graph for explaining a method for deciding whether crimping is normal based on the crimper heights.
Figure 9:
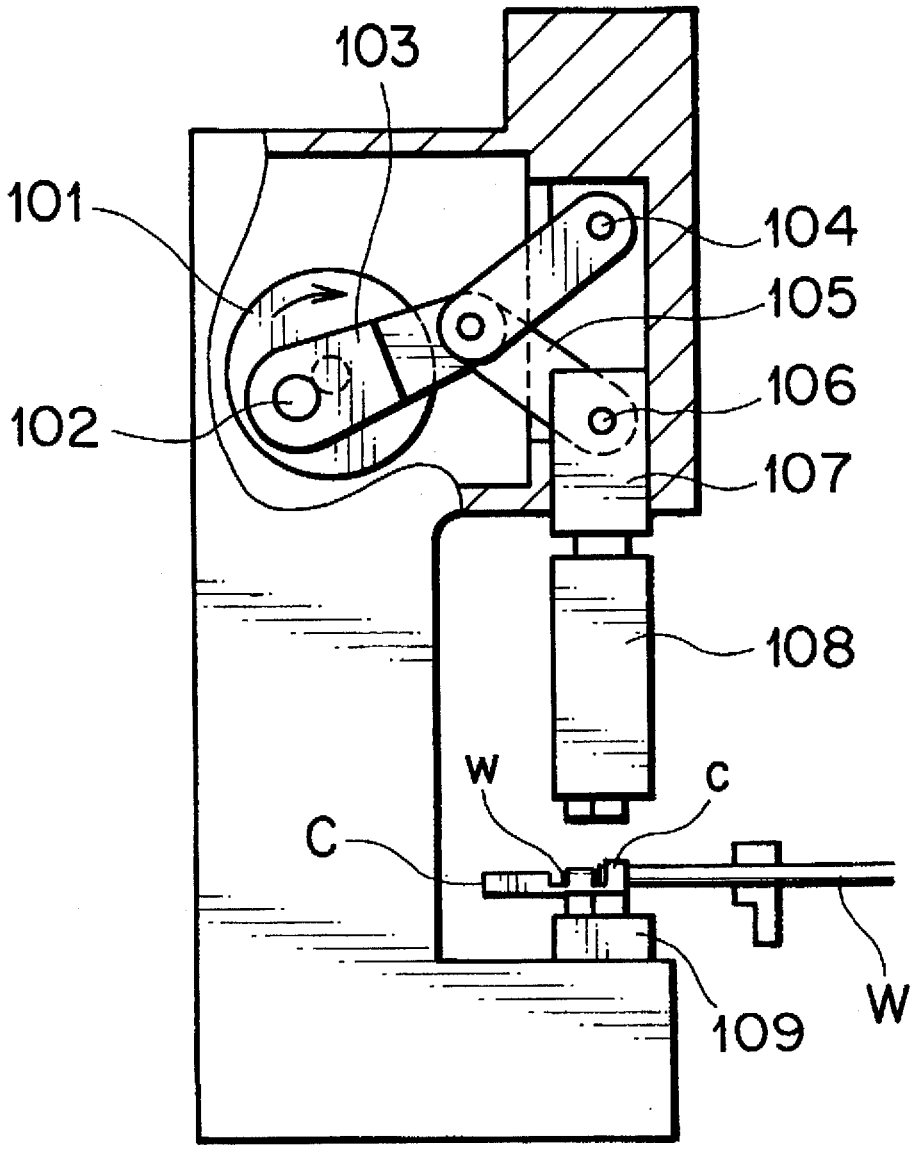
FIG. 9 PRIOR ART
FIG. 9 is an illustration explaining a form of terminal crimping apparatus of the prior art.
Figure 10:
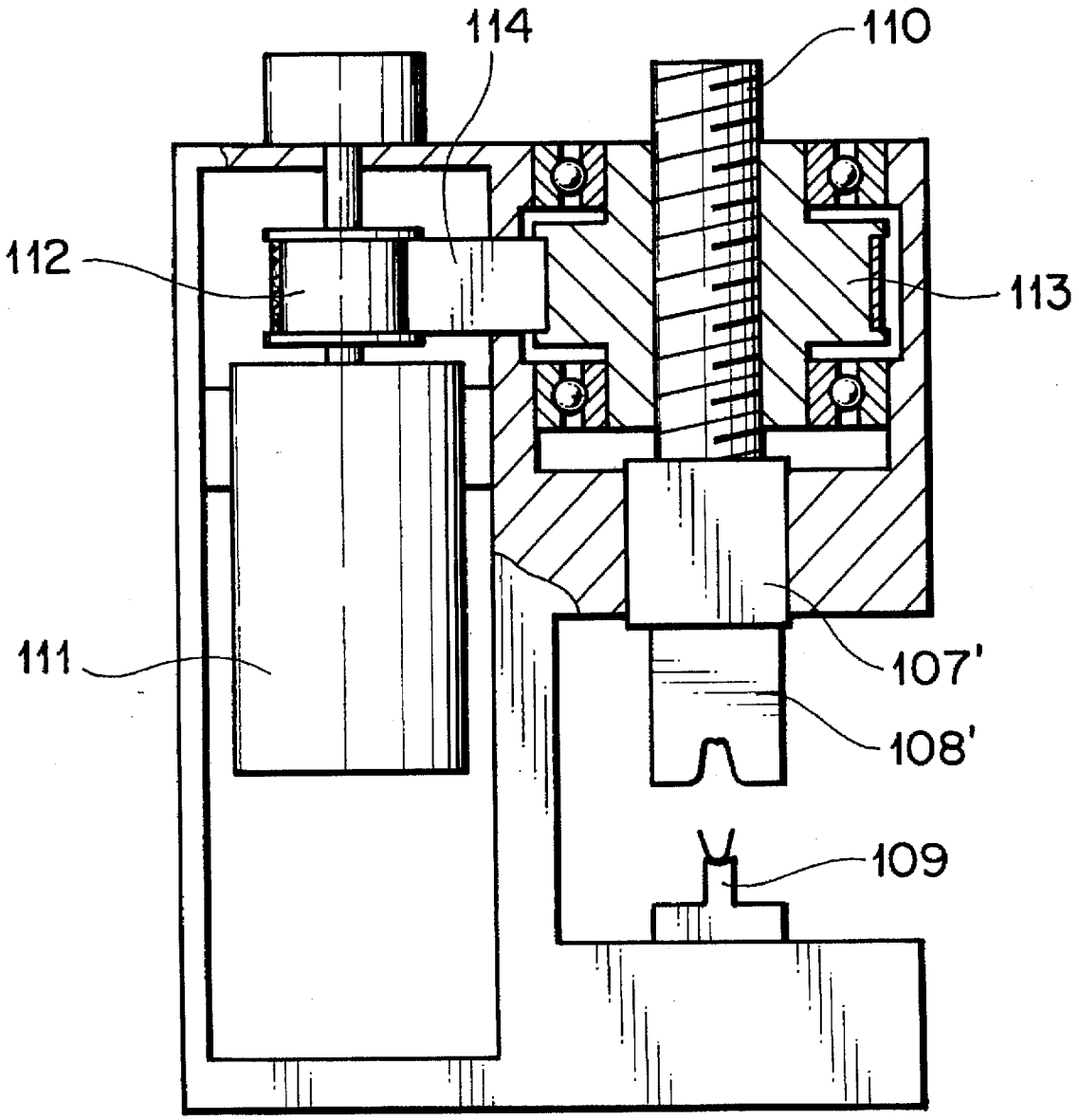
FIG. 10 PRIOR ART
FIG. 10 is an illustration explaining another form of terminal crimping apparatus of a prior art.
Figure 11:
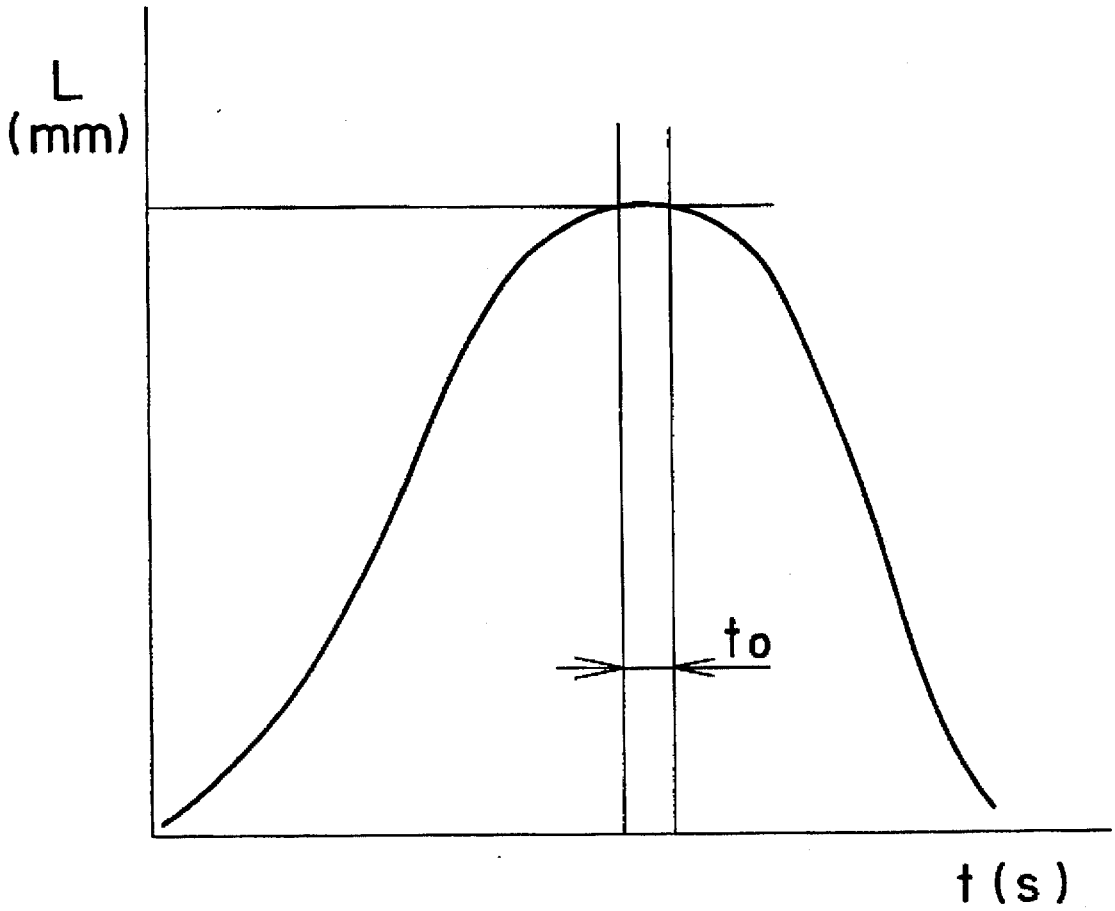
FIG. 11 PRIOR ART
FIG. 11 is a typical graph showing the relation between time and the position of a crimper in a terminal crimping operation regarding a terminal crimping apparatus of the prior art.

Further, FIG. 8B shows an output from the height sensor 32 when a terminal is crimped. Naturally, when a terminal is just crimped, if there are no cores in the cable or if an insulated wire is crimped, the resulting crimp height outputted at each time interval becomes lower than, or is different from, the normal crimp height. Therefore, in the present invention, whether the crimping is normal is decided based on the thus-changed crimp height.

A first decision method, as shown in FIG. 8A, includes the steps of; reading out a maximum value among driving currents recorded in the step S11 in a predetermined period; deciding whether the maximum value is within the standard values stored in the data storage section 23; and deciding whether the crimping has been normally carried out based on that the maximum value is within the range of the standard values.

A second decision method includes the steps of; recording reference currents during a predetermined period in the data storage section 23; obtaining the differences between the time series current values recorded in the step S11 and the reference currents; and deciding whether the crimping has been normally carried out based on that the difference is within a predetermined range.

A third decision method includes the steps of; obtaining the sum of the current values recorded in the step S11 at constant intervals during a predetermined period; and deciding whether the crimping has been normally carried out based on that the sum is within a predetermined range.

A fourth decision method includes, as shown in FIG. 8B, the steps of; recording heights outputted from the height sensor 32 by way of I/O 29-5 in data recording of the step S11; obtaining a minimum value among the recorded data; and deciding whether the crimping has been normally carried out based on that the minimum value is within a predetermined range.

A fifth decision method includes the steps of; recording heights outputted from the height sensor 32; obtaining a minimum value among the recorded data; and comparing the time series heights with the corresponding reference values, and deciding whether the crimping has been normally carried out based on that the differences are within a predetermined range.

Moreover, the decision may be carried out based on both the driving current and the crimper height.

In the embodiment of the present invention, as mentioned above, the off-center pin 8 pivots within the range of 0 to 180 degrees and a crimp height (the lowest position of the crimper 14) is adjusted by the pivoting range of the off-center pin 8. That is, random adjustments of crimp height are capable by controlling the number of rotations in the servo-motor 4 by the driver 34.

Further, monitoring load currents I in the servo-motor 4 or monitoring the height of the crimper 14 can decide whether the crimping operation is normal or not, that is, whether a product is non-defective during crimping operation. Moreover, a stopping period t is provided during crimping operation so that the terminal barrel is prevented from its spring-back, resulting in reliable, stable crimping and reliable products.

In the above-mentioned crimping method, the forwardly and reversely rotating electrical servo-motor 4 is adopted to vertically reciprocate the crimper 14, the electrical servo-motor may be replaced by a hydrostatic servo-motor.

What is claimed is:

1. A method of crimping a terminal barrel to a wire laid on an anvil by a crimper driven by a servo-motor through a piston crank mechanism having an off-center pin, the forward and reverse rotations of said servo-motor vertically reciprocating said crimper, said method comprising:

preliminarily recording reference speeds or accelerations of said crimper at vertical positions of the reciprocating movement thereof, and the reference value of a current which is supplied to said servo-motor when the terminal is crimped;

descending said crimper at the recorded reference speeds corresponding to the crimper positions while said crimper descends from its top position to its crimping start position;

crimping said terminal when the off-center pin is positioned at an intermediate position between its top dead point and its bottom dead point by supplying said servo-motor with said recorded reference current for a predetermined prolonged period sufficient to prevent spring back of said terminal barrel.

2. A method as claimed in claim 1, wherein the crimper descending speeds are considerably smaller between the crimping-contact start position and the crimper descending bottom position than between the crimper ascending top position and the crimping-contact start position.

3. A method as claimed in claim 1, wherein said crimper begins to make contact to the terminal in a speed considerably decelerated before the contact.

4. A method as claimed in claim 1, wherein an encoder provides pulses corresponding to the rotation angles of said servo-motor so as to determine the positions of said crimper.

5. A method as claimed in claim 1, wherein detecting changing positions of said crimper provides actual speeds of said crimper.

6. A method as claimed in claim 1 wherein pivoting angles of said servo-motor are recorded by an encoder and including the step of varying the location of said crimping start position by supplying said servo-motor with said recorded current reference value for crimping in response to the occurrence of a predetermined number of pivoting angles of said servo-motor as indicated by said encoder.

7. A method as claimed in claim 1 including the steps of determining whether a terminal is correctly crimped by sensing the current supplied to said servomotor and determining if the current required to crimp said terminal falls within predetermined upper and lower current limits.

8. A method as claimed in claim 1 including the step of determining whether a terminal is correctly crimped by obtaining the current values supplied to said servomotor during a predetermined period and comparing said sensed current values with a predetermined range of reference current values during a corresponding recorded time period.

9. A method as claimed in claim 1 including the step of determining whether a terminal is correctly crimped by obtaining the sum of the current values recorded at constant intervals over a predetermined period and comparing said sum with a predetermined range of reference sums.

10. A method as claimed in claim 1 including the step of determining whether a terminal is correctly crimped by sensing the height of said crimper with respect to said anvil when crimping is complete and comparing said sensed height with a predetermined range of minimum heights.

11. A method as claimed in claim 1 including the step of determining whether a terminal is correctly crimped by sensing the height of said crimper with respect to said anvil when crimping is complete by recording said heights over a predetermined time period and comparing the differences in the recorded heights with a predetermined range of height values.

12. A method as claimed in claim 1 including the step of transmitting rotation of said servo-motor through a reduction gear to vertically reciprocate said crimper.

* * * * *